US007073768B2

(12) United States Patent
Piscovich

(10) Patent No.: US 7,073,768 B2
(45) Date of Patent: Jul. 11, 2006

(54) DEVICE AND METHOD FOR SETTING A FRAME

(76) Inventor: John Piscovich, 10805 Plata Mesa, Reno, NV (US) 89506

( * ) Notice: Subject to any disclaimer, the term of this patent is extended or adjusted under 35 U.S.C. 154(b) by 201 days.

(21) Appl. No.: 10/193,509

(22) Filed: Jul. 12, 2002

(65) Prior Publication Data

US 2004/0007655 A1 Jan. 15, 2004

(51) Int. Cl.
*E04G 17/00* (2006.01)
*E01C 7/00* (2006.01)

(52) U.S. Cl. ..... 249/207; 249/2; 249/10; 248/346.07; 248/913

(58) Field of Classification Search ..... 249/2, 249/8, 82, 207, 155, 157; 248/346.07, 913; 52/645

See application file for complete search history.

(56) References Cited

U.S. PATENT DOCUMENTS 2,809,414 A 10/1957 Mitchell
3,215,382 A * 11/1965 Stein ..... 248/172
3,266,767 A 8/1966 Long
3,476,351 A 11/1969 Burdett
3,885,762 A * 5/1975 Sebastiani ..... 248/346.07
4,252,291 A 2/1981 Armas
4,614,326 A 9/1986 Strickland et al.
4,637,585 A 1/1987 Picollo
4,867,600 A 9/1989 Bowman
4,963,053 A 10/1990 Bowman
5,039,248 A 8/1991 Bowman
5,332,191 A * 7/1994 Nolan ..... 249/2
5,603,474 A * 2/1997 Weber ..... 248/346.07
5,913,501 A * 6/1999 Heuss et al. ..... 248/346.07
5,943,832 A * 8/1999 Russell ..... 52/645
6,427,396 B1 * 8/2002 Harrison ..... 52/645
6,450,469 B1 * 9/2002 Okuno ..... 248/346.07

* cited by examiner

*Primary Examiner*—Michael Safavi
(74) *Attorney, Agent, or Firm*—Ian F. Burns; Ian F. Burns & Associates

(57) ABSTRACT

The present invention comprises an apparatus for supporting a frame from a utility container. The apparatus comprises a plurality of support members being configured to form a box. The support members are slidably attached to each other. The apparatus further comprises at least one actuator being positioned between and attached to the support members. When the actuator is caused to lengthen, the support members slide away from each other until the box maintains position in the utility container thereby providing support to the frame.

8 Claims, 12 Drawing Sheets

DEVICE AND METHOD FOR SETTING A FRAME

FIELD OF INVENTION

The present invention relates to a method and apparatus for setting utility container frames in concrete.

BACKGROUND

Most streets, parking lots, and other paved surfaces have utility containers placed underneath them for housing or providing access to various utilities, such as storm drains, gas lines, telephone lines, sewer lines, cable television lines, power lines, etc. Each utility container generally has a frame that defines an opening for providing access to the container. In general, the frame is positioned so that it is a predetermined orientation to the paved surface. For example, it is often desirable for the frame to be positioned so that it is substantially flush with the paved surface.

As an example, many paved surfaces have gutters to catch and carry off runoff fluids, such as rainwater. Gutters generally channel runoff to catch basins that are placed underneath the gutters. The catch basins collect the runoff and channel it to a storm drain system where the water is disposed.

A catch basin frame is typically positioned on top of each catch basin. A catch basin frame typically includes a hood, which later becomes a part of a street curb. The structure of a typical catch basin frame defines a hole and a removable grate is usually provided for covering the hole and preventing large objects from falling into the catch basin. The top surface of the catch basin frame and the grate usually lie on about the same plane as the street to provide a substantially even surface.

Gutter construction typically starts by planning the location of the gutter and the location of the catch basin. A hole is then dug in the ground and a catch basin is placed inside the hole. A frame is set on top of the catch basin and concrete is poured around the frame.

Setting the frame on top of the catch basin is complicated because many regulating entities require the frame to be a certain distance from the catch basin so that the resulting gutter forms a substantially even surface relative to the paved surface. Many regulating entities also require the frame to be a certain grade or angle relative to the pavement surface so that runoff is efficiently drained off of the pavement.

One prior art method of setting frames uses a readily available material to achieve the proper distance and the proper grade of the frame relative to the catch basin. For example, contractors place rocks, bricks, beer bottles, or soda cans in between the frame and the catch basin in order to place the frame in the correct position. One problem with this method is it involves a lot of time, effort, and skill to find the right size of material to fit between the frame and the catch basin. It is the Applicants' experience that it takes a contractor at least an hour to set the frame using this method.

Another problem with this method is that the frame is easily disrupted because the materials in between the frame and the catch basin do not provide a stable support structure. If the frame moves, then the contractor must spend more time re-adjusting the frame position to meet the distance and grade requirements discussed above.

Another problem with this prior art method is that it leaves gaps in between the frame and the catch basin. When concrete is poured around the frame, the concrete may leak through these gaps and collect in the catch basin. Thus, after every gutter construction, concrete must be removed from the catch basin to maintain the efficiency of the catch basin. Additionally, objects used to support the frame, such as rocks, bricks, beer bottles, soda cans, and the like, stick in the concrete after the concrete dries. It leaves a void between the frame and the top of the concrete box, which requires grouting with no structural value.

Another prior art method uses grade rings to set the frame a certain distance and grade from the catch basin. Grade rings come in fixed dimensions. Thus, if the contractor has a twelve-inch grade ring and the frame has to be raised more than twelve inches, then the grade ring will not be sufficient to position the frame. Most likely, the contractor must resort to the prior art method described above and thus deal with the same problems described above.

Other prior art methods exist for forming concrete curbs. One prior art method is disclosed in the Picollo patent (U.S. Pat. No. 4,637,585). Picollo discloses a reusable form for manufacturing curb inlet drains in situ. The form is understood to comprise a central key section to which a plurality of drain forming elements are detachably secured. Following the formation of a curb inlet drain, each drain forming element is detached and removed upwardly away from the drain.

W. E. Mitchell patent (U.S. Pat. No. 2,809,414) discloses a form for concrete curb openings. The form comprises a pair of spaced channel members, transverse members attached to channel members, horizontal and vertical supports, angle members attached to the vertical supports, and a cover plate suspended from the angle members. When a concrete curb opening is cast, the form is positioned to allow the cover plate to overlie and completely close the drain inlet. Concrete filling is poured with suitable reinforcing wires or rods arranged in position to reinforce the structure. The form is removed by loosening the bolts fastening the parts together.

The problem with Picollo and W. E. Mitchell, as with other prior art methods, is that it uses multiple components to form a concrete curb. Assembly and disassembly of each of the components are time consuming and labor intensive. Another problem is that the dimensions of the form are fixed, and thus the frame cannot be adjusted to achieve the desired distance from the catch basin or the desired grade relative to the ground.

Another prior art method is H. D. Burdett patent (U.S. Pat. No. 3,476,351). H. D. Burdett discloses a form for forming the catch basins, wherein the form can inwardly deflect. Strickland et al. (U.S. Pat. No. 4,614,326) discloses another form for casting catch basins, which comprises outwardly facing form panels disposed to form a box with at least two movable corner members being located at diametrically opposite corners of the box. While these references provide a form for making catch basins, they do not provide a form for laying concrete in between the frame and the catch basin. There is still a need for a simple apparatus that can be used to support the frame from the utility container and, at the same time, an apparatus that provides a form when pouring concrete around the frame.

SUMMARY

Advantages

One or more embodiments of the present invention may achieve, but do not necessarily achieve, one or more of the following advantages:

allow utility container frames to be set using minimum components;

allow utility container frames to be quickly and easily set;

allow utility container frames to be accurately set a predetermined distance and grade from a utility container;

allow utility container frames to be set without leaving any components in the utility container;

allow utility container frames to be set without using fixed dimension devices, such as grade rings;

provide variable grade and distance between the frame and the utility container.

allow frames for utility containers to be set with minimal labor and time.

provide a re-usable apparatus for setting a frame over a utility container.

prevent concrete spills into utility containers.

provide an apparatus and method for supporting a frame from a utility container that minimizes clean up time and effort.

provide an apparatus and method for supporting a frame from a utility container that results in smooth curbs and gutters.

provide an apparatus and method for supporting a frame from a utility container that results in clean curbs and gutters without residual frame support materials.

These and other advantages of certain embodiments of the present invention may be realized by reference to the remaining portions of the specification, claims, and abstract.

BRIEF DESCRIPTION OF THE ASPECTS OF THE INVENTION

The present invention comprises an apparatus for supporting a frame from a utility container. The apparatus comprises a plurality of support members being configured to form a box. The box comprises overlapping sides, which are slidably attached to each other. The apparatus further comprises at least one actuator being positioned between and attached to the support members. When the actuator is caused to lengthen, the support members slide away from each other until the box maintains position in the utility container thereby providing support to the frame.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The preferred embodiments of the present invention are shown in the accompanying drawings where.

DETAILED DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Prior Art

Figure 1A:
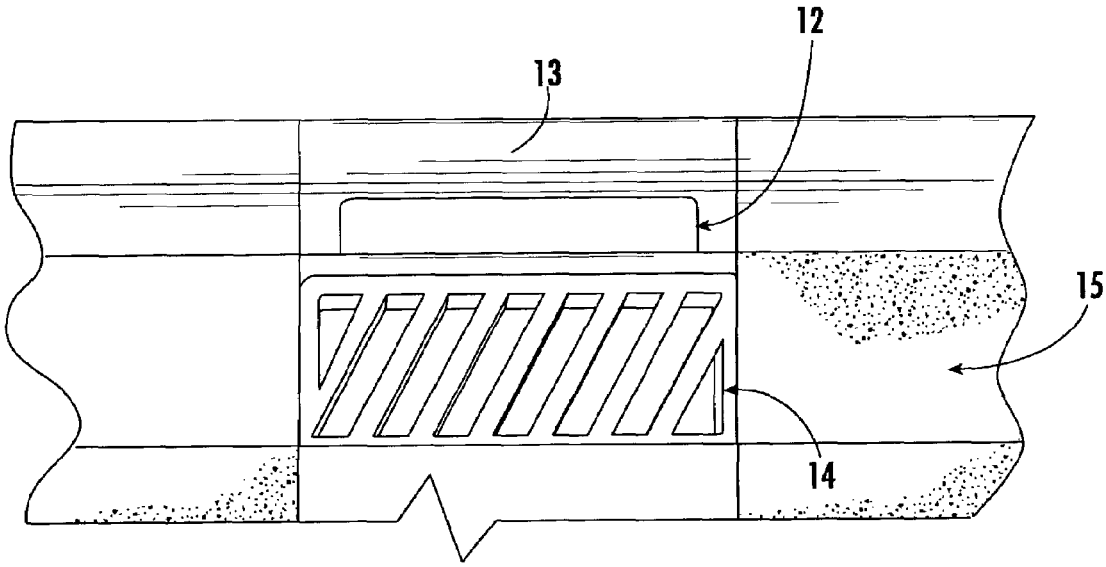
FIG. 1A. (PRIOR ART)
FIG. 1A is substantially a perspective view showing curb and gutter resulting from prior art apparatus and method shown in FIG. 1B.
Figure 1B:
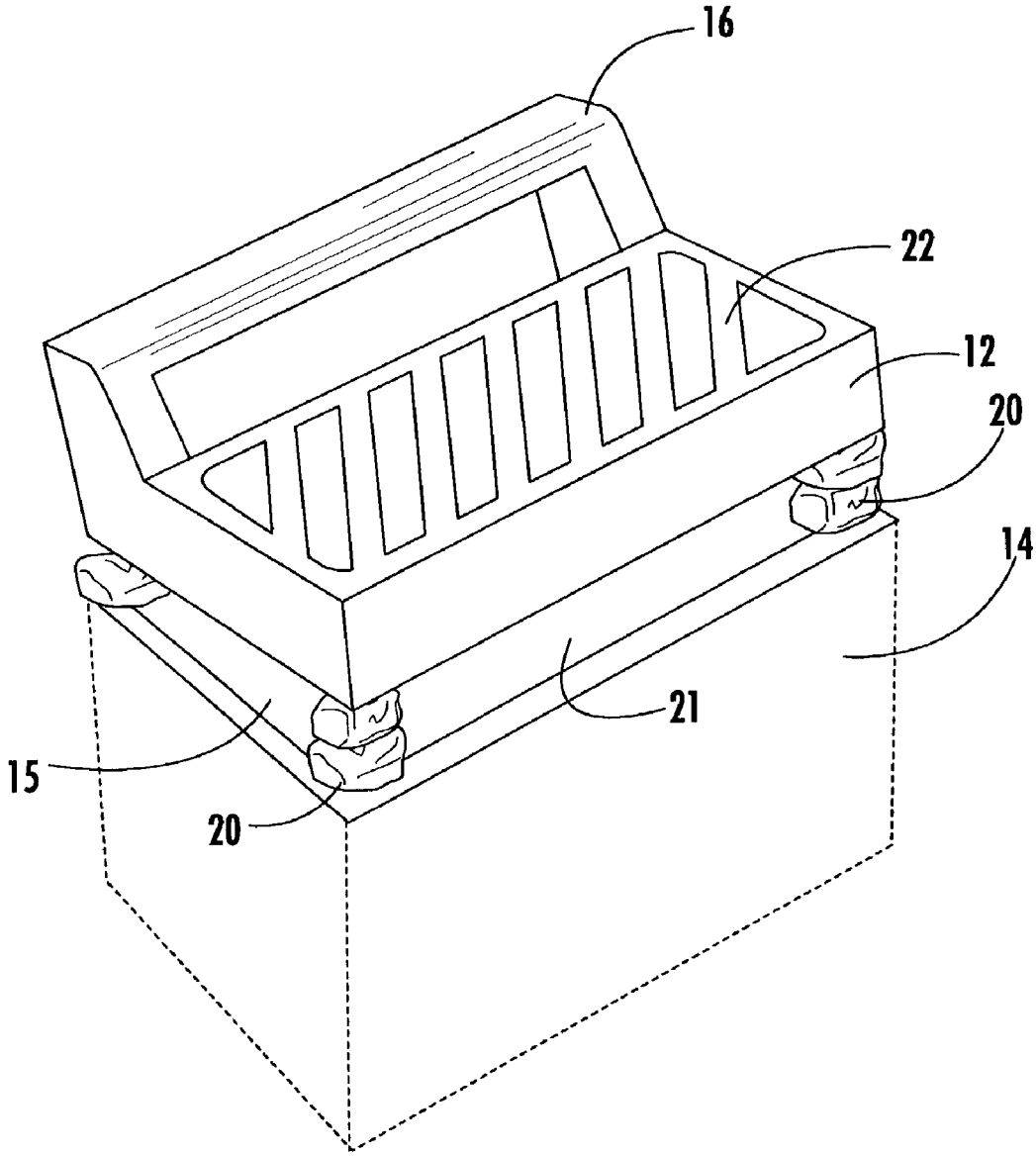
FIG. 1B. (PRIOR ART)
FIG. 1B is substantially a perspective view showing prior art apparatus and method for setting frame over a utility container.

FIGS. 1A and 1B shows a prior art method of setting a frame 12 over a utility container 14 to create a curb 13 and gutter 15. Container 14 is placed in a hole in the ground a predetermined depth below the pavement surface. A top opening is formed by the walls of container 14 for providing access to the interior of the container from the top. Other openings (not shown) may be provided in the container for providing access to utility lines, such as pipes or conduits. Frame 12 is set on top of utility container 14. In most cases, frame 12 is set so that its upper surface is in a desired orientation. For example, in the case of a curb and gutter, it is usually necessary for the upper surface of frame 12 to be substantially flush with the surface of the gutter (not shown). Since gutters usually have a predetermined grade to hold and channel runoff, it is necessary to set frame 12 so that its upper surface also has this grade.

In the prior art, frame 12 may be set over utility container 14 using rocks 20, bricks (not shown), wood (not shown), beverage bottles (not shown), cans (not shown), or any other available objects that could support frame 12 and hold the frame at a desired grade. A person skilled in the art would appreciate that it takes a lot of time and experimentation to set frame 12 at the desired grade using this method.

Once frame 12 is set in a position and with a desired grade, concrete may be poured around the frame to form the curb and gutter. Concrete forms (not shown) may be used to form the curb and gutter.

Frame 12 may comprise hood 16 and removable grate 22. After concrete is poured and dries, hood 16 becomes part of the curb and grate 22 covers the street gutter. A person skilled in the art would also appreciate that, with the prior art method, concrete may leak into utility container 14 through the gaps 21 between rocks 20. The concrete may substantially interfere with the function of container 14, such as providing a space to hold equipment or channeling runoff to a storm drain system. This may require workers remove the concrete from container 14. Additionally, rocks 20, wood (not shown), beverage bottles (not shown), cans (not shown), or any other objects that were used to support frame 12 are permanently embedded in the concrete. If the objects project into the opening in the container, it may be necessary for workers to remove these objects. Thus, the prior art method requires a lot of clean-up time and effort.

Present Invention

Figure 2:
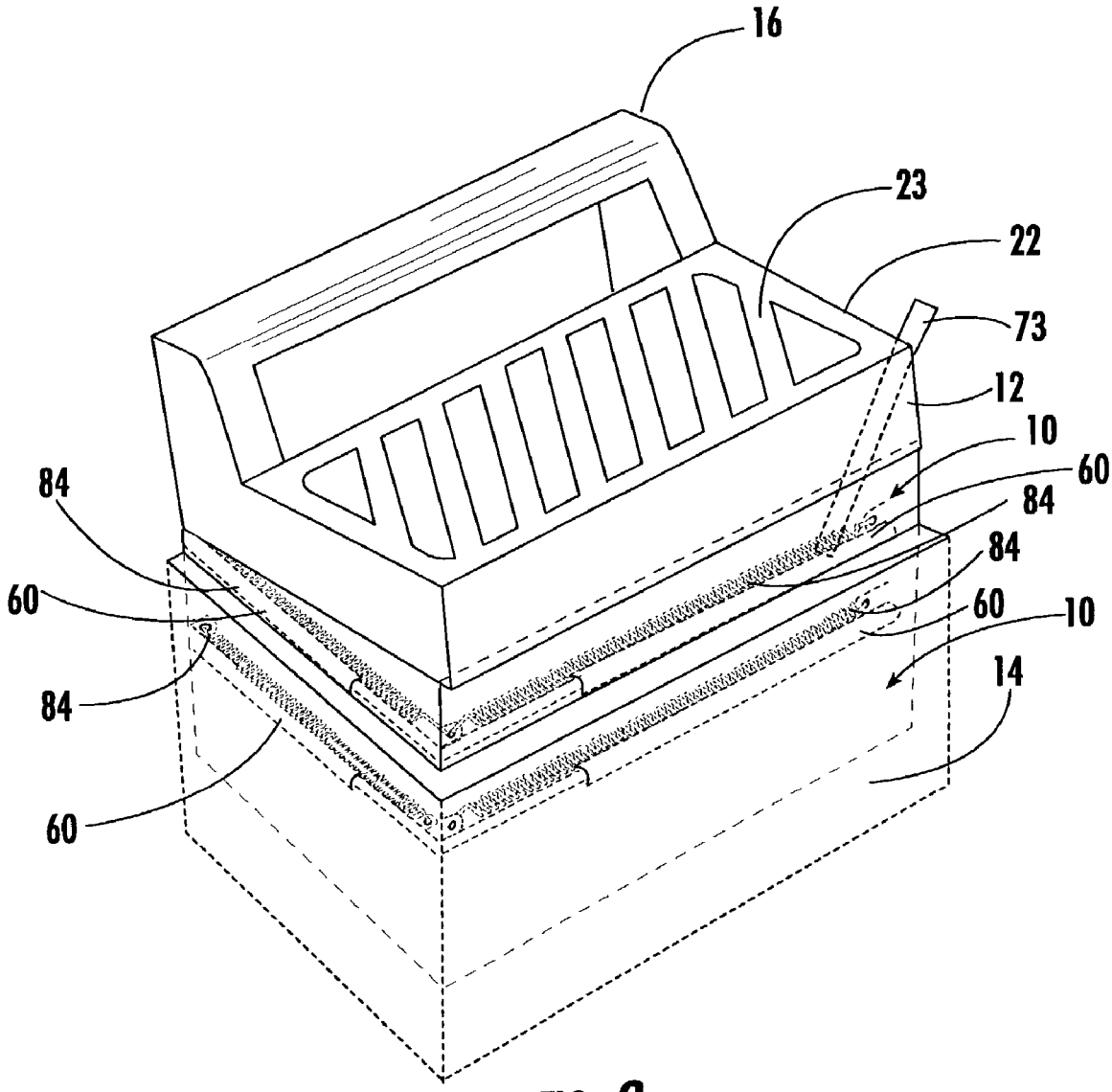
FIG. 2 is substantially a perspective view showing apparatus and method for setting a frame over a utility container.
Figure 3:
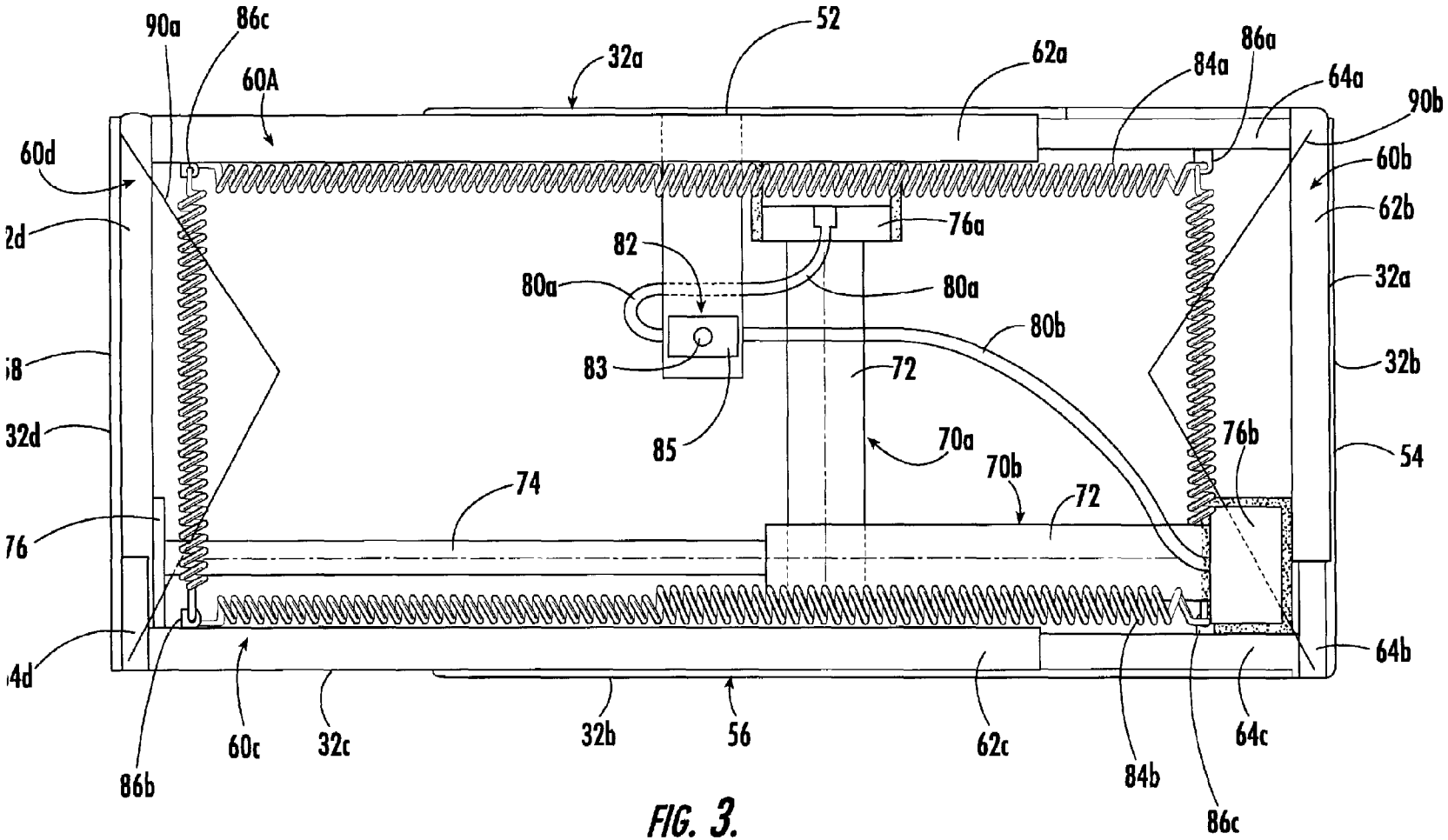
FIG. 3 is substantially a top view of a frame setter.

Referring now to FIG. 2, the present invention comprises a frame setter, generally indicated by reference number 10. Frame setter 10 may be used for setting frame 12 over utility container 14. As shown in FIG. 3, frame setter 10 has support members 32 and at least one actuator 70.

Support Members

Figure 4:
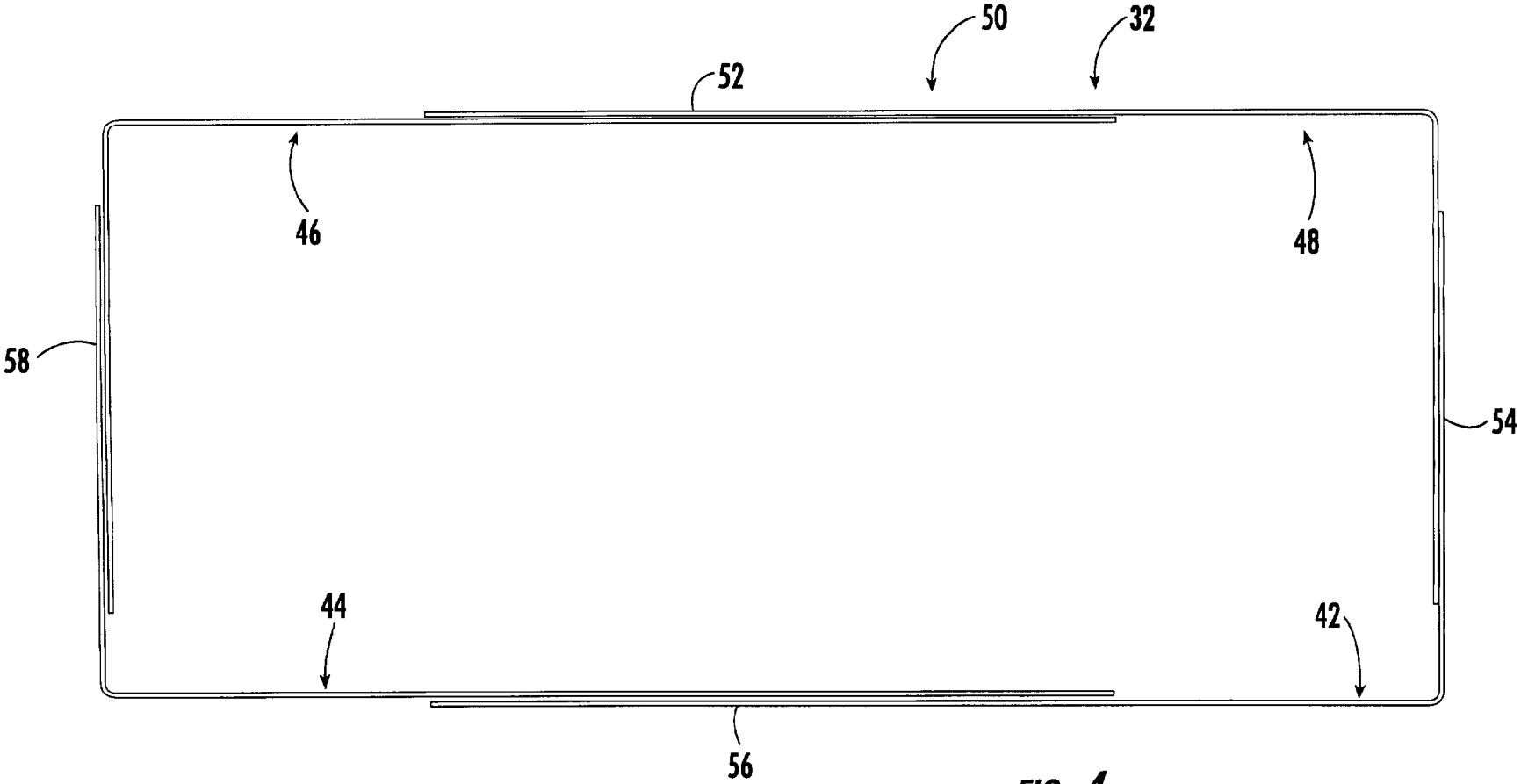
FIG. 4 is substantially a top view of the support members.

FIG. 4 shows a top view of a plurality of support members 32. Each support member 32 preferably comprises an L-shaped body. In the preferred embodiment, frame setter 10 comprises four support members 42, 44, 46, 48 being configured to form a box 50. Box 50 may be rectangular or square, depending on the dimension and relative position of the support members.

Box 50 comprises overlapping sides 52, 54, 56, 58. Back side 52 comprises back left support member 48 at least partially overlapping back right support member 46. Front side 56 comprises front left support member 42 at least partially overlapping front right support member 44. Right side 58 comprises front right support 44 member at least partially overlapping back right support member 46. Left side 54 comprises front left support member 42 at least partially overlapping back left support member 48.

Height of back side 52 may be different from the height of front side 56, depending on the desired grade of frame 12. Left side 54 and right side 58 are slanted accordingly. The desired grade of frame 12 is usually set by certain standards, such as municipal codes. For example, the height of back side 52 is thirteen inches and the height of front side 56 is ten inches complies with standards used in Reno, Nev. Support members 32 are preferably made of aluminum because it is lightweight, inexpensive, and durable. Support members 32 may also be made of other types of metals, metal alloys, fiberglass, wood, or other materials known in the art.

Figure 5:
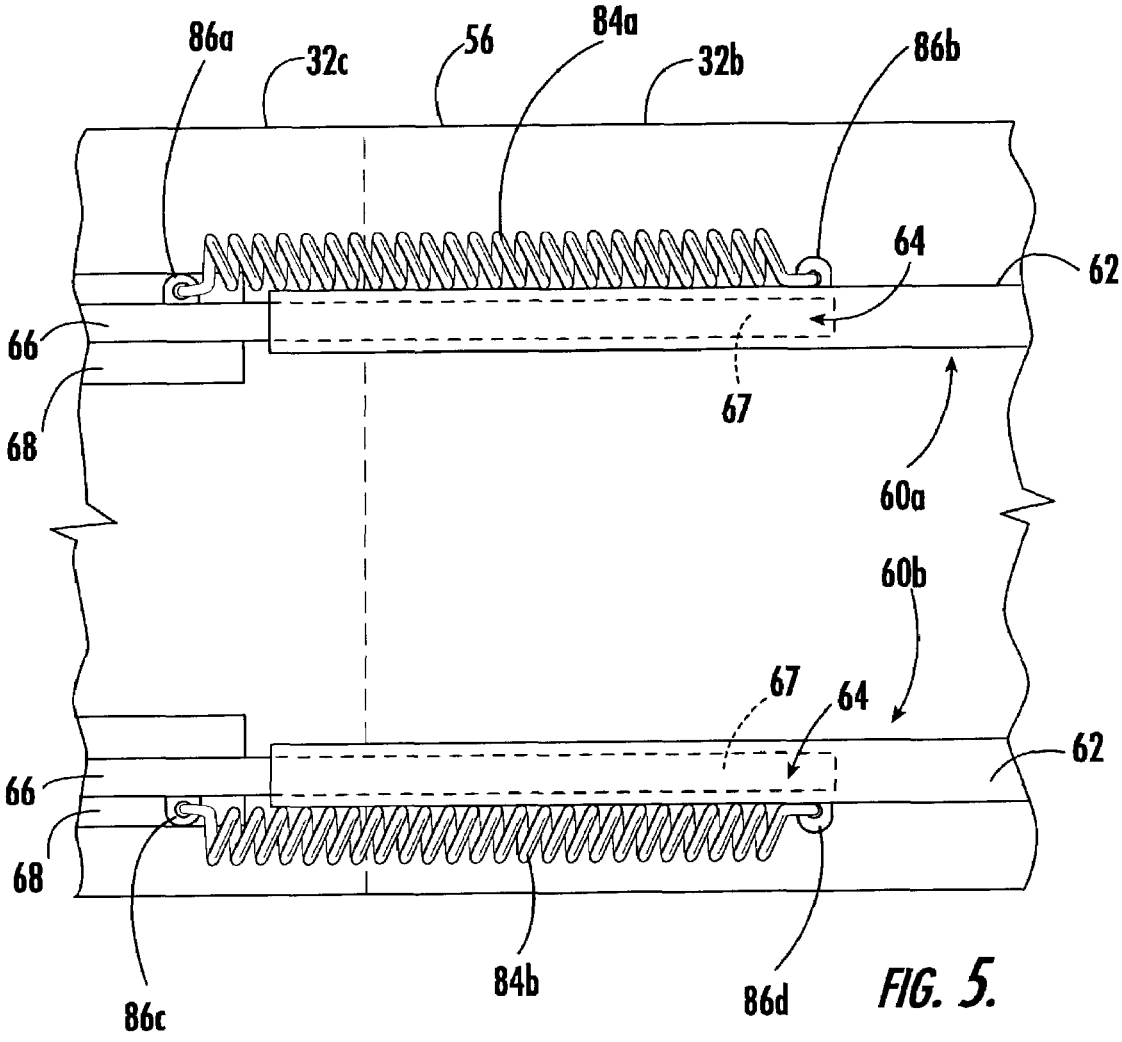
FIG. 5 is substantially a front view of one of the sides of the frame setter.

Support members 32 are slidably attached to each other by at least one guide 60 shown in FIG. 5. In the preferred embodiment, two guides 60*a*, 60*b* slidably attach support members 32*b*, 32*c* to each other. Guide 60 is preferably positioned horizontally across support members 32*b*, 32*c*. Guide 60 may be in a form of a drawer glide, a combination of a channel and a fitting adapted to slide within the channel, or other guides known in the art that could slidably attach support members.

In the preferred embodiment, guide 60 comprises rod housing 62 and rod 64. Rod 64 comprises of a stationary end 66 and a housed end 67. Housed end 67 of rod 64 is movable within rod housing 62. Stationary end 66 is preferably welded to a bracket 68. Bracket 68 is preferably welded to support member 32*c*. Rod housing 62 is preferably welded to across support members 32*b*, 32*c*. Rod 64 and rod housing 62 may be made of various types of metals or materials known in the art.

As shown in FIG. 3, two handles 90*a*, 90*b* are preferably welded to guides 60*a* and 60*b*. Handle 90 is preferably elongated. Handle 90 may be made of chains, ropes, or other materials known in the art.

Actuator

Figure 6:
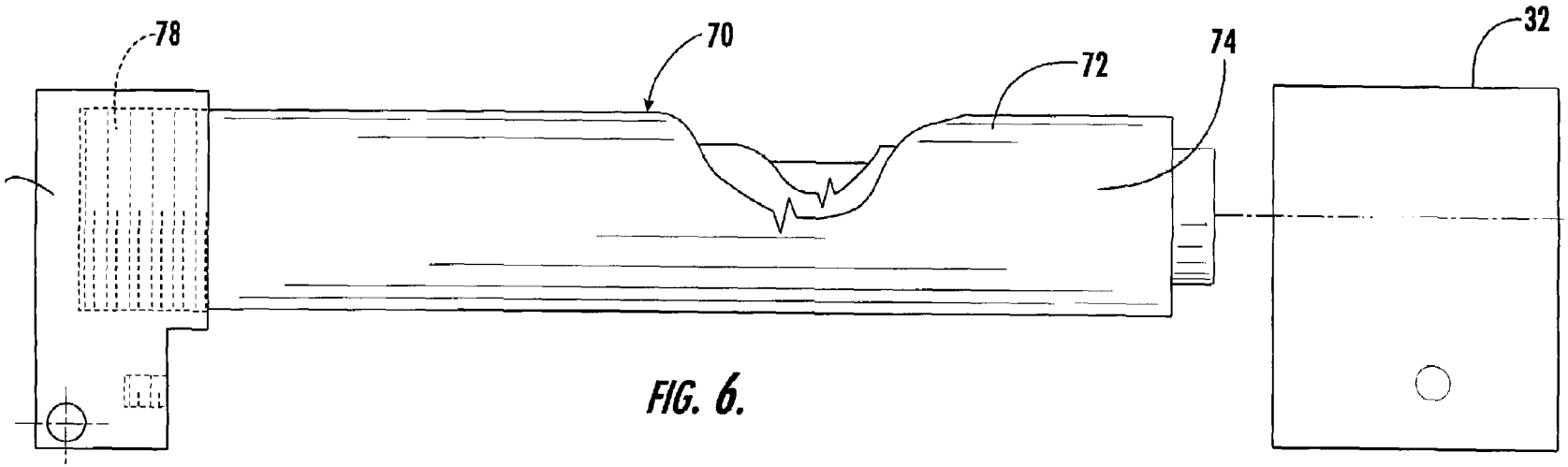
FIG. 6 is substantially a front elevational view of one of the actuator.

Referring now to FIGS. 3 and 6, frame setter 10 comprises at least one actuator 70. Actuator 70 is preferably adapted to lengthen and shorten thereby causing support members 32*a*, 32*b*, 32*c*, 32*d* to slide relative to each other. Frame setter 10 preferably comprises two actuators 70*a*, 70*b* arranged perpendicularly relative to each other. Each actuator 70 is also positioned across at least two sides 52, 54, 56, 58 of box 50. Perpendicular arrangement of actuators 70*a*, 70*b* allows support members 32 to move in the x and the y-axis. Actuator 70 may be in the form of a pressure-activated piston, motor-activated worm gear, pulleys, cables, or other actuators known in the art. Pressure for activating, lengthening, or shortening actuator 70 may be provided using a hydraulic mechanism, air compressor, a motor, a mechanical force, or other methods known in the art.

In the preferred embodiment, each actuator 70*a*, 70*b* is a pressure-activated piston. Each actuator 70*a*, 70*b* comprises a vessel 72 and a fitting 74. Fitting 74 is movable within vessel 72. Vessel 72 is attached to a vessel mount 76 where pressure 78 is introduced. Vessel mount 76 is preferably welded on a support member 32.

Figure 7:
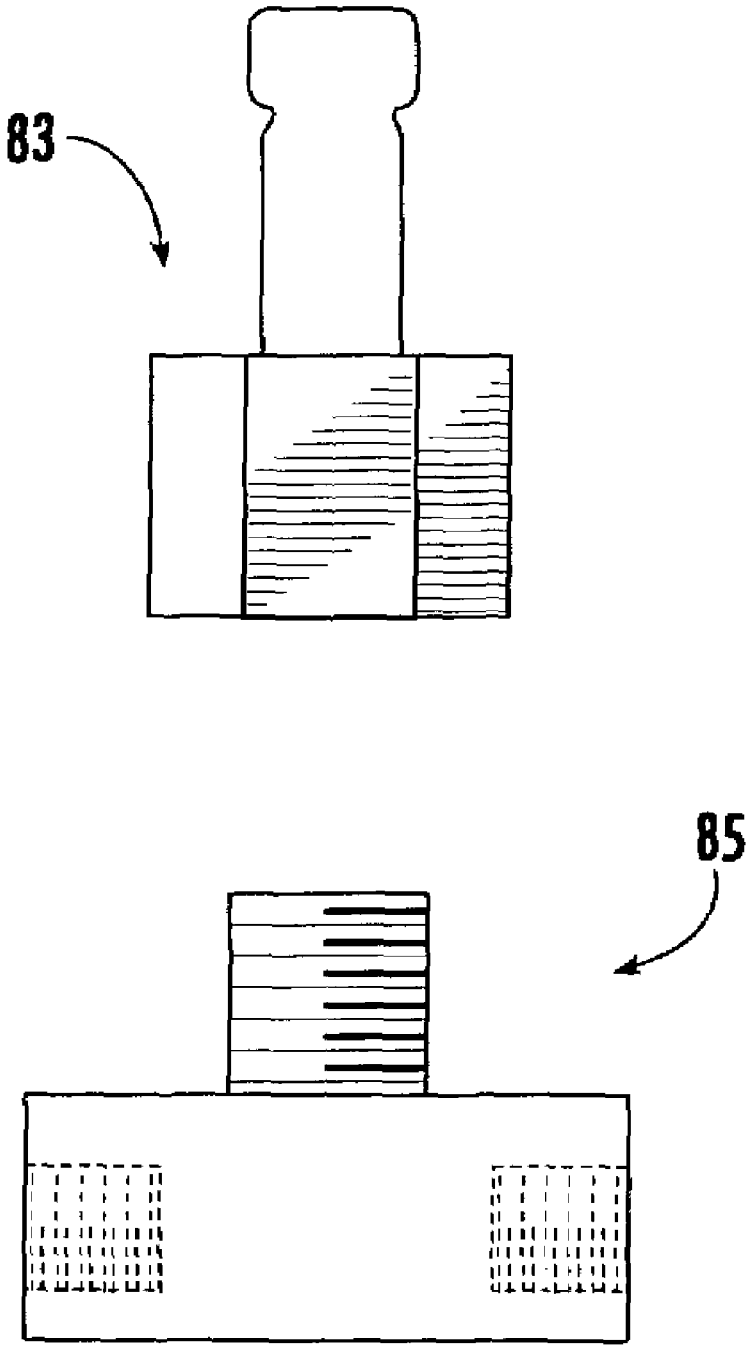
FIG. 7 is substantially a front view of the pressure source connection.

As shown in FIG. 3, vessel mount 76*a*, 76*b* of each actuator 70*a*, 70*b* is connected to pressure source connection 82 via a hydraulic hose 80 having requisite fittings. Pressure source connection 82 is preferably a quick coupler 83 mounted on a tee 85 shown in FIG. 7. Pressure 78 is supplied by manual hydraulic jack (not shown), which preferably operates with water or water solution such as water and anti-freeze. The manual hydraulic jack may also operate with oil. The manual hydraulic jack is known in the art and may be obtained from Quickshore Weststar of Sacramento, Calif. The hydraulic jack (not shown) is attached to quick coupler 83 to introduce or remove pressure 78 into actuator 70. Quick coupler 83 allows the hydraulic jack to be detached while actuators 70*a* and 70*b* are under pressure. When pressure 78 is introduced, fitting 74 is adapted to lengthen and apply force against support member 32 causing support members 32 to slide away from each other.

When pressure 78 is reduced, fitting 74 is adapted to shorten and allow support member 32 to slide back to its original position. In the preferred embodiment shown in FIGS. 3 and 5, at least one biasing device 84 is attached on guide 60. Biasing device 84 may be a spring. Biasing device 84 may be used to aid support members 32 to slide back to its original position.

Biasing device 84 is preferably attached to every guide 60. Biasing device 84 is attached to guide 60 using a biasing device hanger 86. One biasing device hanger 86*a* is preferably welded on stationary end of rod 66 and another biasing device hanger 86*b* is preferably welded on rod housing 62. Biasing device 84 extends between biasing device hangers 86*a*, 86*b*. Ends of biasing device 84 are hooked into corresponding biasing device hangers 86. Actuator 70, vessel mount 76, biasing device 84, biasing device hanger 86 are preferably made of metal, but actuator 70, vessel mount 76, biasing device 84, biasing device hanger 86, may also be made of other materials known in the art. Of course, biasing device 84 may be optional or may vary in number, depending on the actuator used and the desired compressibility of box 50.

Methods of Use

Figure 8:
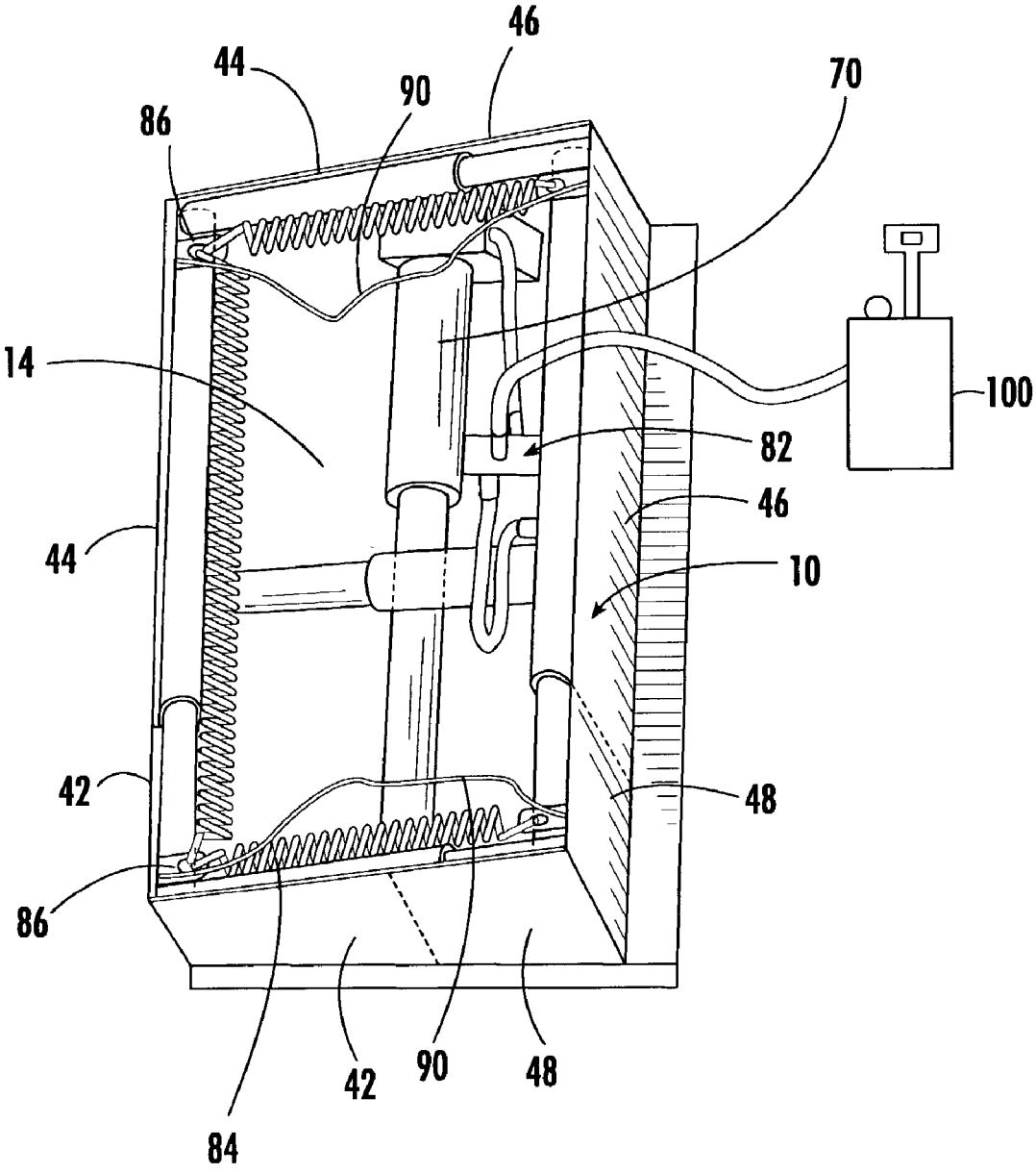
FIG. 8 is substantially a top view of the frame setter being positioned inside a utility container.

Referring now to FIG. 8, method of using frame setter 10 is substantially shown. Desired distance and grade between frame (not shown) and ground is measured. Hydraulic jack 100 is attached to pressure source connection 82. Frame setter 10 is then positioned partially inside utility container 14 so that portion of frame setter 10 outside utility container allows frame to be set at the desired distance and grade.

Pressure is introduced to actuator 70 by pumping the hydraulic jack. Support members 48, 42 slide away from support members 46, 44 in the x-axis. Support members 42, 44 slide away from support members 48, 46 in the y-axis. Sides 52, 54, 56, 58 of box 50 abut sidewalls of utility container to maintain position of frame setter 10. Once frame setter 10 is in a stable and desired position, hydraulic jack is removed from pressure source connection 82.

Frame 12 is placed on top of frame setter 10 as seen in FIG. 2. Some frames may have bottom perimeter that is greater than the perimeter of box 50. To position said frame on top of frame setter 10, a frame supporter 73 of the embodiment shown in FIG. 2 may be used. Frame supporter 73 of the embodiment shown in FIG. 2 may simply be a piece of sturdy metal. Frame supporter 73 may be positioned in between frame setter 10 and frame to allow frame to be positioned on top of the frame setter and prevent frame from falling down.

Figure 11:
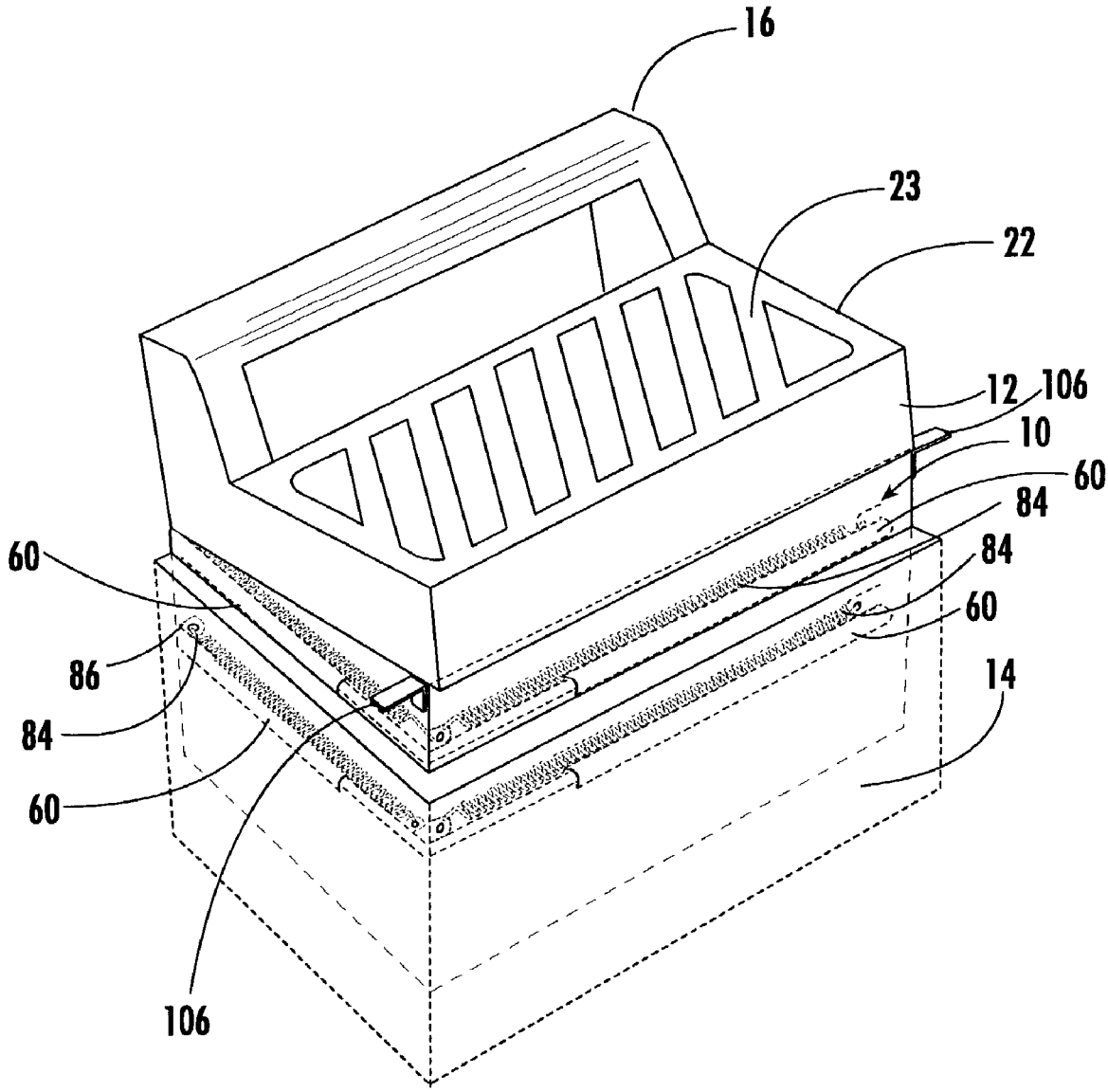
FIG. 11 is substantially a perspective view showing a modified apparatus and method for setting a frame over a utility container.

Another embodiment of frame supporter 106 is shown in FIG. 11. Frame supporter 106 may be a bracket attached to at least one side of box 50. Frame supporter 106 is preferably a sturdy metal bracket welded on the side of box 50, or may be any bracket known in the art that could carry a frame. After frame 12 is placed on top of frame setter 10, concrete may now be poured around the frame setter 10 and frame 12 to create a curb and gutter.

Figure 9:
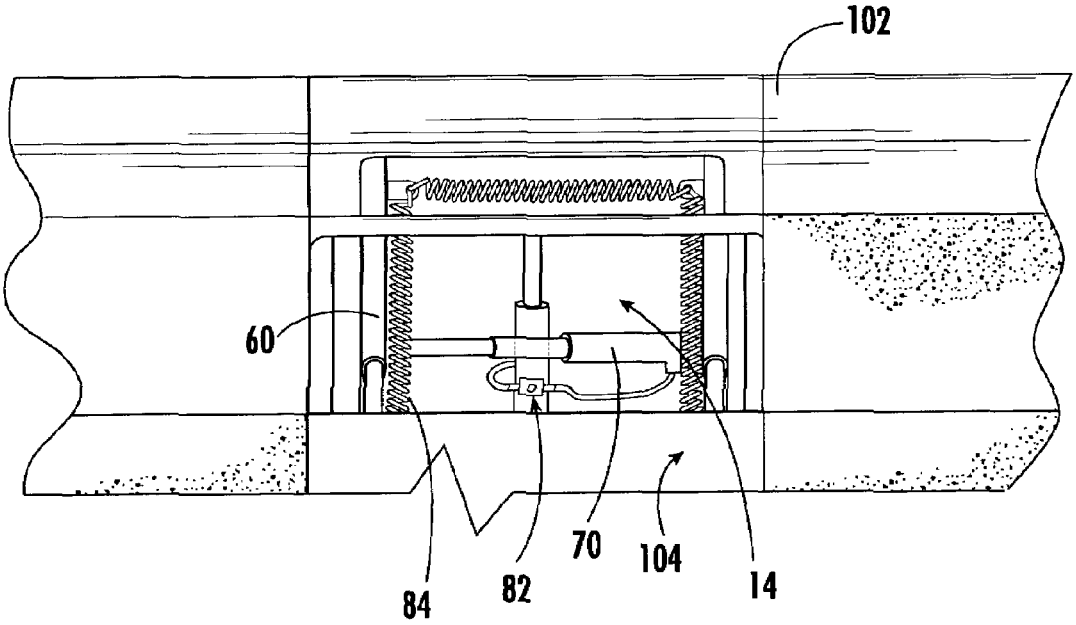
FIG. 9 is substantially a top view of the frame setter after concrete has been poured around frame.
Figure 10:
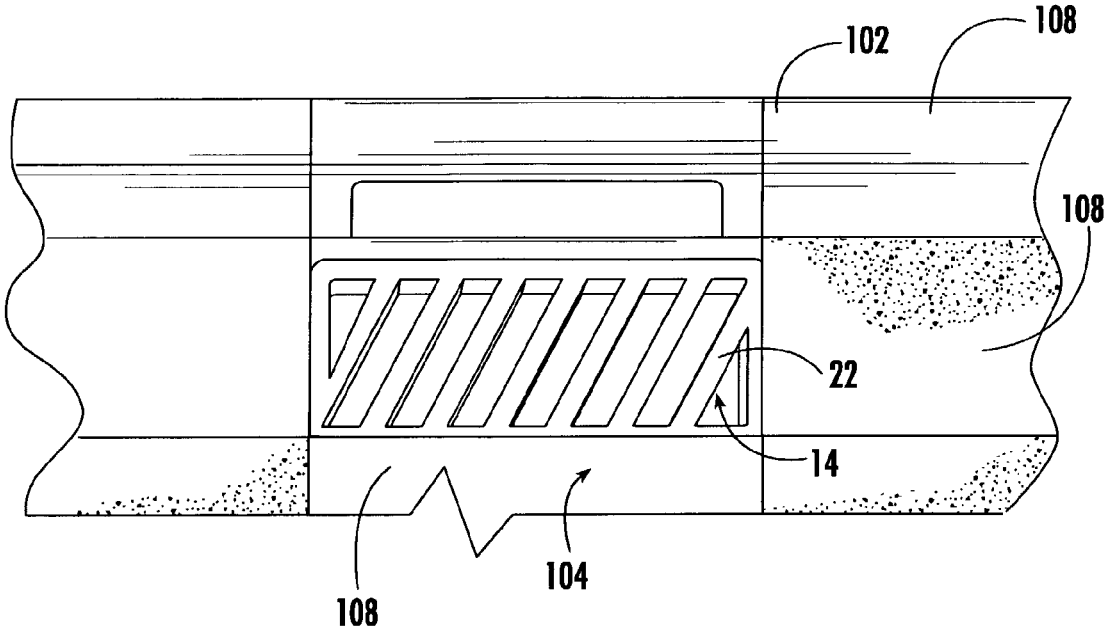
FIG. 10 is substantially a perspective view of the resulting curb and gutter.

As shown in FIGS. 9 and 10, after concrete 108 has dried, frame setter 10 may be removed away from frame 12. Hydraulic jack (not shown) is attached to pressure source connection 82. Hydraulic jack is used to remove pressure from actuators 70*a* and 70*b*. Actuators 70*a* and 70*b* shorten as pressure is reduced. Biasing device 84 compresses causing support members 48 and 42 to slide towards support members 46 and 44 in the x-axis and support members 42 and 44 to slide towards support members 48 and 46 in the y-axis. Dimensions of sides 52, 54, 56, 58 of box 50 will shorten thereby allowing box 50 to be removed away from utility container 14 and frame 12 through frame hole 23. Frame grate 22 may now be replaced to cover utility container 14 of resulting curb 102 and gutter 104. Frame setter 10 may be re-used.

CONCLUSION

Although the description above contains many specifications, these should not be construed as limiting the scope of the invention but as merely providing illustrations of some of presently preferred embodiments of this invention. For example, number, shapes, and placements of guides, biasing devices, and actuators may vary. Guides, handles, biasing device hangers, and actuators may be attached to frame setter using welding, adhesive, or other methods known in the art. Thus, the scope of the invention should be determined by the appended claims and their legal equivalents rather than by the examples given.

What is claimed is:

1. An apparatus for supporting a frame from a utility container, the utility container having at least two opposing walls, the apparatus comprising:

(A) a plurality of support members, the plurality of support members being configured to form a box, the support members being slidably attached to each other, the box comprising at least two sides, one side of the box being configured to have a lower vertical dimension than the other; and (B) at least one actuator, the actuator being attached to the support members, wherein when the actuator is caused to lengthen, the support members slide away from each other until the support members abut the opposing walls of the utility container, thereby maintaining the apparatus in a fixed position in the utility container.

2. The apparatus of claim 1, wherein the actuator is adapted to shorten, wherein when the actuator shortens, the support members slide towards each other thereby allowing the box to be removed away from the utility container.

3. The apparatus of claim 1, further comprising at least one guide, the guide being adapted to slidably attach the support members, the guide comprising a rod and a rod housing, the rod housing being attached to a first support member, the rod comprising of at least a first end and a second end, the first end of the rod being attached to a second support member, the second end of the rod being slidably displaced within the rod housing.

4. The apparatus of claim 1, further comprising a hydraulic pressure system, the hydraulic pressure system being configured to activate the actuator.

5. The apparatus of claim 1, further comprising an air pressure system, the air pressure system being configured to activate the actuator.

6. The apparatus of claim 1, further comprising at least one handle attached to the support members, the handle being configured to allow users to carry the apparatus.

7. The apparatus of claim 1, comprising two actuators, each actuator being attached to the support members, the two actuators being positioned perpendicular to each other.

8. The apparatus of claim 7, further comprising a pressure system, the pressure system being adapted to activate the two actuators.

* * * * *